US006792963B2

(12) United States Patent
Kopel

(10) Patent No.: US 6,792,963 B2
(45) Date of Patent: Sep. 21, 2004

(54) COOLANT FED HUMIDIFIER HAVING SIPHON DRAIN AND METHOD THEREFOR

(75) Inventor: Zev Kopel, Quebec (CA)

(73) Assignee: National Environmental Products, Ltd. (CA)

( * ) Notice: Subject to any disclaimer, the term of this patent is extended or adjusted under 35 U.S.C. 154(b) by 7 days.

(21) Appl. No.: 10/247,117

(22) Filed: Sep. 19, 2002

(65) Prior Publication Data

US 2004/0000335 A1 Jan. 1, 2004

Related U.S. Application Data

(60) Provisional application No. 60/391,678, filed on Jun. 26, 2002.

(51) Int. Cl.[7] ..... F04F 10/00

(52) U.S. Cl. ..... 137/15.05; 137/132; 261/DIG. 46; 392/324

(58) Field of Search ..... 137/15.05, 132; 261/DIG. 46; 392/324

(56) References Cited

U.S. PATENT DOCUMENTS

| | | | | |
|---|---|---|---|---|
| 3,612,033 A | 10/1971 | Chilcoat | 126/113 |
| 3,643,930 A | 2/1972 | Schulze, Sr. | 261/97 |
| 3,716,043 A | 2/1973 | Chilcoat | 126/113 |
| 3,739,597 A | 6/1973 | Schulze, Sr. | 62/311 |
| 4,243,396 A | 1/1981 | Cronenberg | 55/238 |
| 4,705,936 A | 11/1987 | Fowler | 219/295 |

FOREIGN PATENT DOCUMENTS

IT 2365083 11/1983

OTHER PUBLICATIONS

Elsteam Humidifier Brochure with suction drain, Dec. 31, 2001.

*Primary Examiner*—Gerald A. Michalsky
(74) *Attorney, Agent, or Firm*—Robert C. Kain, Jr.; Fleit Kain

(57) ABSTRACT

A hot water humidifier with an automatic siphon drain fed with cooler source water is flushed via a drain. The humidifier includes the humidifier tank and an inverted U-shaped siphon conduit having one end coupled to the tank and the other end coupled to the drain. A valve controlling the cooler source water feeds the water into the tank to maintain the temperature of an admixture of cooler source water and any preexisting tank water at or below a predetermined temperature during a flush cycle. The tank is flushed and drained via the automatic siphon based upon the level of the admixture in the tank and the level of admixture in the siphon. The source water may be coupled to the humidifier tank via the siphon conduit such that cooler source water may be added during the siphoning action. A method of flushing a hot water humidifier is also included.

27 Claims, 2 Drawing Sheets

COOLANT FED HUMIDIFIER HAVING SIPHON DRAIN AND METHOD THEREFOR

This is a regular application based upon and claiming priority of provisional patent application Ser. No. 60/391,678 filed Jun. 26, 2002.

The present invention relates to a coolant fed humidifier, particularly cool water, having a siphon drain.

BACKGROUND OF THE INVENTION

Many humidifiers generate water vapor for heat, ventilation and air conditioning (HVAC) systems by heating water to a boiling temperature and thereby suppling airborne water vapor to the HVAC system in a building. These types of humidifiers sometime suffer from the accumulation of minerals and other water borne particles or elements. In order to continue the efficient operation of this type of humidifier, the humidifier tank is periodically flushed or filled with water from a water supply or water source. Water from the source is usually at a much lower temperature, typically the ambient temperature, and hence, cooler than water in the humidifier tank. Accordingly, it is proper to call this water from the source "coolant" or "cool water."

The control system which triggers the fresh water rinse can use many parameters such as periodic time frames, the amount of input water, seasonal drain cycles, the number of times the water in the humidifier exceeds a certain level or the amount of foam in the humidifier. The present invention can be utilized in conjunction with many types of control systems.

Government regulations in some jurisdictions now require that water from the humidifier tank only be discharged at or below a certain predetermined temperature. In some jurisdictions, the discharged water temperature may not exceed 140° Fahrenheit. The typical temperature in a water humidifier is 212° Fahrenheit when the humidifier is active.

Accordingly, there is a need to provide a mechanism to chill or reduce the temperature of the water in the humidifier tank prior to discharging the water from the tank.

Also, the cost of additional valving is a factor in the production of humidifier systems. The more valves utilized in a humidifier system, the higher the cost. The utilization of additional valves requires additional maintenance. Additional control circuitry and control wiring must also be employed with additional valves. Hence, there is a need for a humidifier system which lowers the tank water temperature to acceptable levels and automatically flushes the system without the need for additional valves and valve control systems.

Nothing in the prior art provides solutions to these problems. For example, U.S. Pat. No. 3,612,033 to Chilcoat discloses a humidifier with a siphon draining a drain off reservoir which is distinct from the humidifier tank. U.S. Pat. No. 3,716,043 to Chilcoat has a similar drain off reservoir.

U.S. Pat. No. 3,643,930 to Schulze discloses a humidifier tank fed with source fluid and an inverted U-shaped siphon drain from the tank. Source fluid, under control, sometimes flushes the tank by raising the fluid level in the tank above the height of the inverted U-shaped siphon thereby causing an automatic siphon drain of the tank fluid. U.S. Pat. No. 3,739,597 to Schulze has a similar automatic siphon.

U.S. Pat. No. 4,243,396 to Cronenberg uses a siphon tube to draw up liquid from a lower liquid source.

U.S. Pat. No. 4,705,936 to Fowler discloses an inverted U-shaped siphon from a boiling tank leading to an adjacent drain tank at the same level as the boiling tank. The fill tube feeding the boiling tank is distinct from the automatic siphon.

OBJECTS OF THE INVENTION

It is an object of the present invention to provide a coolant fed humidifier having an automatic siphon drain.

It is an additional object of the present invention to provide a humidifier which is fed with cooler source water, thereby reducing the temperature of the water in the humidifier tank and then automatically draining the tank water once the tank water exceeds a predetermined level in the tank.

It is a further object of the present invention to provide a humidifier with an automatic siphon drain thereby eliminating additional valves.

It is another object of the present invention to provide a humidifier tank flushing system in which the humidifier tank water is admixed with cooler water, thereby reducing the water temperature of the admixture prior to siphoning and draining the water, and that is also capable of admixing additional cooler water into the admixture as it is being drained through the siphon action such that the new admixture resultant is yet at a lower temperature.

It is a further object of the present invention to provide a method of draining a hot water humidifier.

SUMMARY OF THE INVENTION

A hot water humidifier with an automatic siphon drain fed with cooler source water is flushed via a drain. The hot water humidifier includes a humidifier tank supplied with the cooler source water. The automatic siphon is an inverted substantially U-shaped siphon conduit automatically operable with respect to the humidifier tank having one end coupled to the tank and the other end coupled to the drain. The humidifier also includes a source conduit coupled to and feeding the cooler source water to the humidifier tank. A valve controlling the cooler source water feeds the source water into the humidifier tank to maintain the temperature of an admixture of cooler source water and any preexisting tank water at or below a predetermined temperature during a flush cycle. The tank is flushed and drained via the automatic siphon based upon the level of the admixture in the tank and the level of admixture in the siphon. The source conduit which feeds water to the tank may be coupled to the humidifier tank via the siphon conduit. The apex of the siphon conduit is positioned at a level above the end of the siphon conduit coupled to the humidifier tank. The source conduit may also be coupled to the humidifier tank in more than one location to promote admixing of the cooler source water with the hot water in the tank. A temperature sensor may also be disposed within any of the areas containing the admixture, including the tank and associated conduits, to provide feedback to the valve controlling the input of source water into the system. In addition, cooler source water may be added to the admixture as it is draining during the siphon action in order to further lower the temperature of the admixture.

A method of draining a hot water humidifier having a humidifier tank supplied with cooler source water is also included. The method includes admixing the cooler source water in the tank with the hot water until the admixture reaches a predetermined siphon height and is less than a predetermined temperature, and thereafter, automatically siphoning and draining the admixture until the admixture reaches a lower siphon exhaustion height.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

Further objects and advantages of the present invention can be found in the detailed description of the preferred embodiments when taken in conjunction with the drawings.

Figure 1:
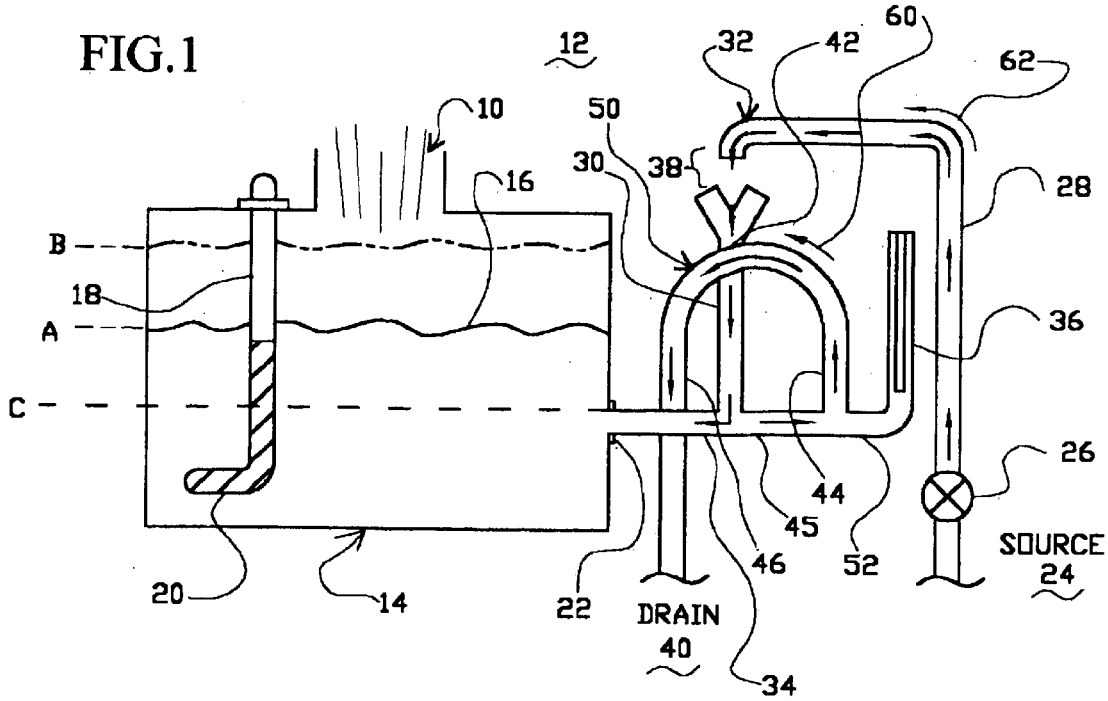
FIG. 1 diagrammatically illustrates the humidifier system fed with source water and having a siphon drain.

The present invention relates to a humidifier fed with coolant or cooler source water and having a siphon drain. FIG. 1 diagrammatically illustrates humidifier system 12 having a humidifier tank 14. Tank water 16 is shown at level A in tank 14. Heating element 18 has an active heating element segment 20. Humidifier tank 14 is typically stainless steel. Water or coolant 16 is typically fresh water. Heating segment 18 may include, in some embodiments, a temperature sensor. Typically, the control system for the humidifier utilizes float switches (not shown) to detect upper and lower tank water levels. Other water level sensors are available (e.g., electronic sensors 36).

Tank 14 is supplied with liquid coolant 16, which is typically water, and drained via port 22 located at a lower part of the holding tank. In the embodiment illustrated in FIG. 1, water 16 is supplied to the tank via water source intake 32. Intake or source conduit 32 includes an air gap coupling 38. Some jurisdictions have enacted building codes which require an air gap be installed on all water supply valves connected to the municipal or commercially available water system in order prevent contamination of the drinking water supply through inadvertent back flow. Alternatively, a one-way valve or check valve 80 (see FIGS. 3 & 4) may also be used to prevent water flow back into the water system. Of course, the backflow prevention valve 80 is not a requirement for system operation. Similar features are identified herein using the same reference characters throughout the specification.

Figure 4:
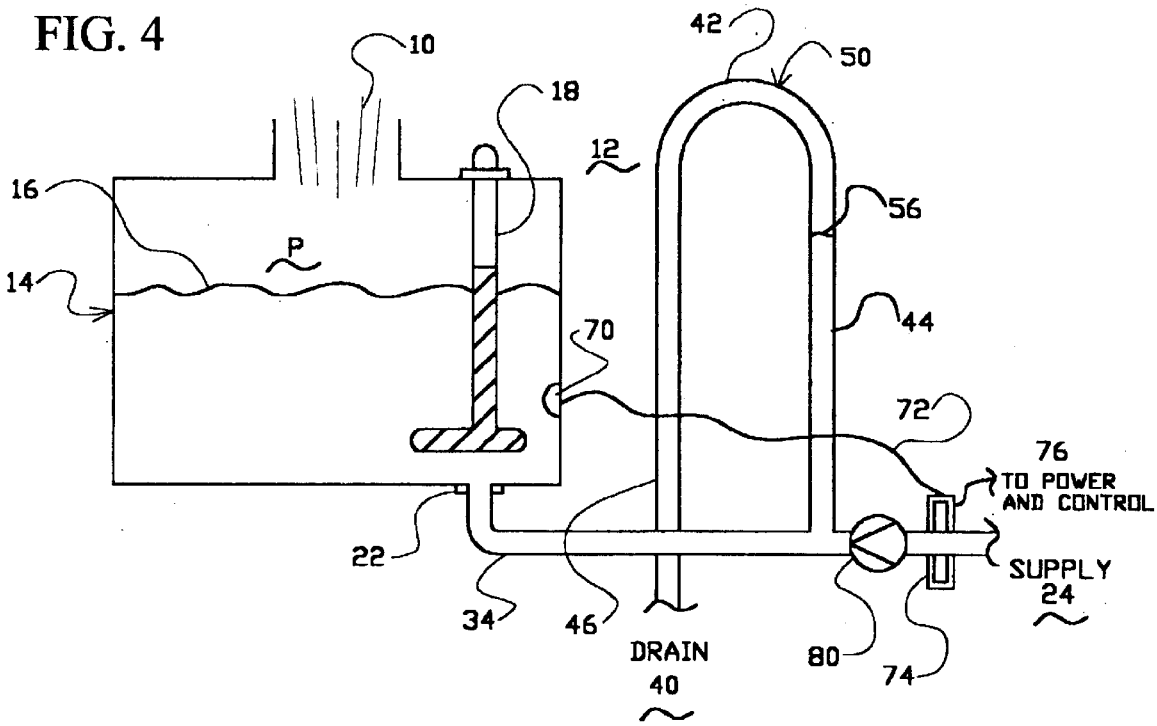
FIG. 4 diagrammatically illustrates an alternative embodiment of the automatic siphon drain system for hot water humidifiers.

In operation, water is fed from source 24 through valve 26 (typically a solenoid valve) via input pipe or conduit segments 28 and 30. Air gap coupling 38 of source conduit 32 couples input pipe segments 28, 30. In FIG. 1, intake or source conduit 32 is fluidly coupled to holding tank 14 via siphon conduit 50. Siphon conduit 50 is an inverted, substantially U-shaped conduit or tube with an apex 42 and two substantially downwardly facing conduit segments or legs 44, 46. The first downwardly facing conduit segment 44 is connected at its terminal end to T-coupler 52. One side of T-coupler 52 is fluidly coupled to port 22 via conduit or pipe segment 34, and the other side of T-coupler 52 is coupled to level sensor system 36. Fluid level sensor system 36 may be used to monitor the level of fluid in tank 14 such that valve 26 is opened when the liquid in tank 14 has evaporated below a predetermined level. It may also be used to begin a flush cycle of tank 14 as discussed below. The second downwardly facing conduit segment 46 is fluidly coupled to drain 40. Drain 40 is located lower than the bottom of holding tank 14 and may be connected to the sewer drain system or a nearby drain field. In FIG. 1, the apex 42 of inverted U-shaped siphon conduit 50 is positioned at a level below a top of the holding tank 14 such that the siphon tube segment 44 may fill as the tank 14 is filled until the level of liquid in the tank reaches the apex 42 whereupon the siphon conduit 50 automatically begins siphoning liquid from tank 14 into drain 40 via siphon conduit 50. Hence, the U-shaped siphon conduit 50 is automatically operable with respect to the humidifier tank 14 once the correct level of water is reached in the tank. In another embodiment, the apex 42 is at a level parallel with or slightly higher than the top of humidifier tank 14 (FIG. 4). The humidifier system 12 typically operates in connection with an HVAC system. Accordingly the steam or vapor output 10 and the remaining water 16 in the tank 14 are subjected to the static pressure P present in the air duct system. Hence, during operation of the HVAC system, there may be greater pressure P exerted within humidifier tank 14 than the atmospheric pressure present within siphon conduit 50. Accordingly, siphon conduit 50 may be designed with the apex 42 level with or slightly higher than the top of tank 14, and still remain automatically operable with respect to the level of fluid in tank 14. The top of humidifier 14 in FIG. 4 is not open to atmospheric pressure, but is closed and vented to the HVAC air duct system, subject to the system static pressure P.

During a fill cycle under normal operation of the humidifier, valve 26 is opened, allowing coolant water to flow through input pipe segments 28, 30, through pipe segment 34 into port 22, and ultimately, into humidifier tank 14. The water level A in tank 14 is monitored by the water level sensor system 36 which is hydraulically linked to the hydraulic piping connected at port 22. Water level sensor 36 can be one of various sensor systems as known to those skilled in the art and may be located directly in tank 14. Over time, as more and more water evaporates, impurities in the coolant water and other sediment accumulate at the bottom of the holding tank 14 or are suspended in the remaining hot water in the tank. During operation of the humidifier, the water temperature may reach 212 degrees Fahrenheit.

When the remaining water 16 and tank 14 must be flushed and drained, the remaining water 16 should to be cooled to the required or predetermined lower temperature. Some governmental agencies establish that the flush water should not exceed 140° Fahrenheit or some other predetermined temperature. Other temperatures could be set by other governmental agencies or by HVAC engineers or contractors. In any event, water 16 in humidifier tank 14 is almost always hotter, during regular humidifier operation, than the temperature of water from source 24. When necessary as described above, tank water 16 must be cooled to a lower temperature prior to being discharged into drain 40. Upon command by the control system, valve 26 is opened and cooler source water or coolant is fed into tank 14 via valve 26, pipe segments 28, 30 and pipe segment 34. When the water in tank 14 reaches or exceeds predetermined level B (higher than level A), the temperature of the tank water should be at or below the prescribed temperature. The system may be designed such that a predetermined volume of cooler source water 24 is admixed into the tank 14 to bring the resultant admixture within a predetermined, acceptable temperature limit. Variables to determine the amount of water to admix may include the tank dimensions, the volume of water capable of flowing into the tank 14 and the temperature/volume of normal operating water quantities. A temperature sensor 70 (FIG. 4) may also be used to control the quantity of cooler water admixed into tank 14. The cooler water from source 24 admixes with the hotter water 16 in tank 14 creating a lower temperature admixture of liquid. The admixing also functions to stir the water 16 in the tank, thus temporarily suspending accumulated sediment and particles at the bottom of the tank 14. When the admixture reaches water level B and begins to exceed the height of siphon top or apex 42 of siphon conduit 50, a siphon action is created with the formation of the column of water in siphon segment 46. Siphon conduit 50 is an inverted U-shaped pipe fluidly coupled to the bottom of tank 14 via pipe segment 34 and subsidiary segment 45. The siphon action continues, draining the admixture in tank 14 into drain 40, until the water reaches lower level C which is generally at the level of port 22. In this manner, there is no need for an additional drain valve. This reduces the cost of the system and potentially reduces maintenance of the system.

To describe the operation of the system in a different manner, when the admixture of hot water in tank 14 and the cooler source water exceeds the siphon height (at or exceeding level B) at the top of the inverted U-shaped siphon, the system automatically drains the tank water by siphon action. The height of the siphon or siphon apex 42 may be determined upon the volume of water required to bring the admixture in the tank 14 within an acceptable upper temperature limit. In the embodiments illustrated in FIGS. 1 and 2, the apex 42 of siphon conduit 50 is located at or below the top of the tank 14. However, as illustrated in FIG. 4, the apex 42 of siphon conduit 50 may be higher than the top of tank 14 in systems exposed to the HVAC static pressure P present in the duct system which is higher than the normal atmospheric pressure present at the discharge side 46 of siphon conduit 50.

One advantage of the embodiment illustrated in FIG. 1 is the ability to regulate the temperature of the admixture being drained into drain 40. If, based upon the operating parameters and the size of the tank, the temperature of the admixture drain water is not at or below the predetermined low discharge temperature level, or it is desirable to lower the temperature of the admixture resultant further, source water may be added to the automatic siphon discharge by partially or intermittently opening valve 26 and adding cool source water to the warmer drain water. The addition of source water to the drain water will reduce the temperature of the drain water at or below the prescribed level as it is being removed through siphon conduit 50. Valve 26 could be partially ON, fully ON or pulse width modulated (PWM), that is, ON/OFF for predetermined time periods, until the drain water is at or below the predetermined temperature. The addition of source water 24 to the output drain water is possible as long as the source fluid flow is less than and no greater than the siphon drain flow through the inverted U-shaped siphon conduit 50. Port 22 is effectively the exhaustion height of the siphon drain because, when water 16 is at or below height C, the siphon is broken or "exhausted" and therefore stops draining water through the inverted U-shaped drain siphon tube 44.

Water flow in inverted U-shaped siphon conduit or piping segment 50 flows in direction 60. Cool source water flows in direction 62. Water flows in both directions through conduit segment 34 based upon whether valve 26 is open thereby permitting the input of source fluid into humidifier tank or based upon the siphon action through siphon conduit 50 in direction 60. Fluid flow through pipe segment 45 follows direction 60 in the siphon conduit 60.

Figure 2:
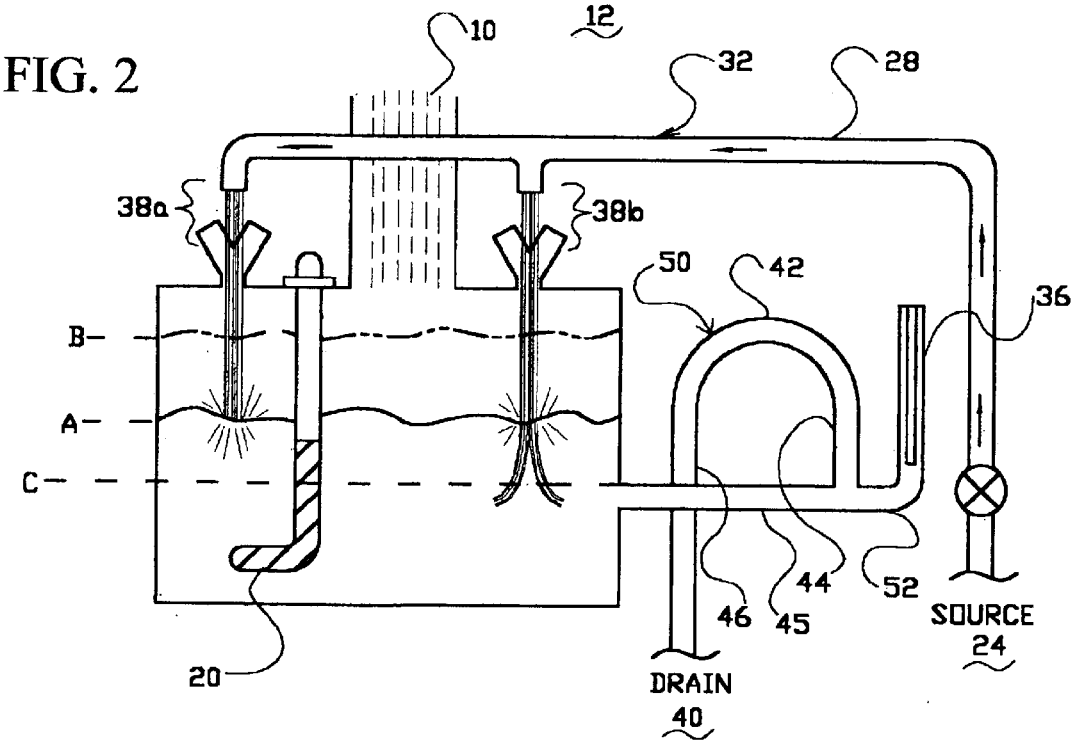
FIG. 2 diagrammatically illustrates an alternative arrangement of the hydraulic system for the siphon drain.

FIG. 2 diagrammatically illustrates the automatic siphon system 12 in which the coolant water source 24 is fluidly coupled to tank 14 via coolant source intake 32 which has two air gap couplers 38*a*, 38*b* disposed atop tank 14. As illustrated, this embodiment promotes a vigorous mixture of the hot fluid in the container 14 with the new coolant being added. The system 12 illustrated in FIG. 2 works in substantially the same manner as the system in FIG. 1, with the exception of the how the coolant source water reaches tank 14. A hybrid of the two embodiments may also be implemented in which a segment of pipe fluidly coupled to pipe segment 28 allows source water 24 to be added directly into pipe segment 45 such that the addition of coolant water at pipe segment 45 effectively brings down the temperature of the drain water being drained through siphon conduit 50 during a flush cycle.

Figure 3:
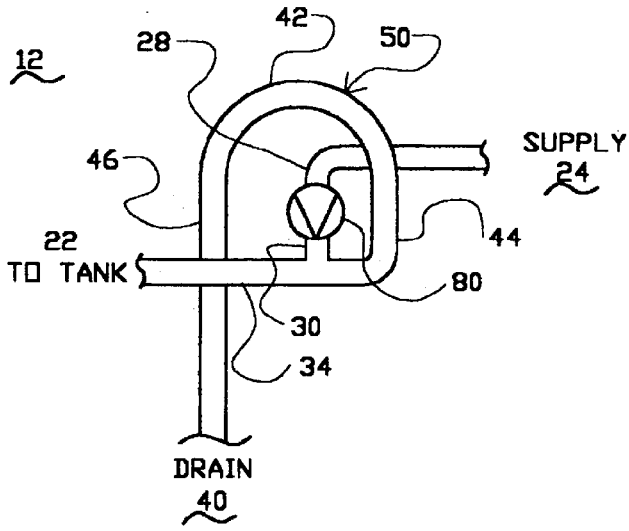
FIG. 3 diagrammatically illustrates the automatic siphon drain with a one way valve at the coolant supply.

FIG. 3 diagrammatically illustrates an alternative embodiment of the automatic siphon drain system 12. A one-way valve 80 is used rather than air gap coupling 32 to connect conduit section 28 and conduit section 30 leading to intermediate conduit 34 and ultimately to port 22 and tank 14. One-way valve 80 may be a check valve or flapper valve as is known to those of skill in the art.

FIG. 4 diagrammatically illustrates the automatic siphon drain system 12 with a temperature sensor 70 disposed within holding tank 14. The admixture temperature sensor 70 may be disposed anywhere within the system such that the sensor is exposed to the admixture resultant. For example, sensor 70 may be disposed within conduit segments 34 or 44. The temperature sensor 70 is coupled to a valve actuator 74 at coolant supply 24 via feedback line 72. The valve actuator 74 may also be a solenoid valve. Feedback line 72 provides the valve actuator 74 feedback on whether the temperature of the admixture in tank 14 requires more coolant. Feedback line 72 may also be coupled to HVAC controls via line 76. In FIG. 4, port 22 is located at the bottom of the tank 14, thus promoting a thorough flush of the tank during a cleaning cycle. In this embodiment, heating element 18 should be turned off during the flush cycle to avoid overheating of the element.

The embodiment illustrated in FIG. 4 includes a siphon conduit 50 having its apex 42 at a level slightly higher than the top of tank 14. This configuration is possible because of the higher static air pressure P present in tank 14 as a result of the static pressure P in the air ducts of the HVAC system. The steam or vapor output 10 and the water 16 in tank 14 are subjected to the air duct static air pressure P. During operation of the HVAC system, the greater air pressure (in comparison to the atmospheric air pressure present in conduit segment 46) exerted within humidifier tank 14 causes the water level 56 in siphon conduit segment 44 to rise higher than the water level in tank 14. Accordingly, the automatic siphon action will occur even though the water level in tank 14 is lower than the admixture water level in siphon conduit 50.

The claims appended hereto are meant to cover modifications and changes within the scope and spirit of the present invention.

What is claimed is:

1. A method of draining a hot water humidifier having a humidifier tank supplied with cooler source water comprising:

admixing said cooler source water in said tank with said hot water until the admixture reaches a predetermined siphon height and is less than a predetermined temperature; and thereafter, automatically siphoning and draining said admixture until said admixture reaches a lower siphon exhaustion height; and adding said cooler source water downstream of said lower siphon exhaustion height to further lower the temperature of said admixture.

2. A method of draining a hot water humidifier as claimed in claim 1 including the step of setting said siphon height by a maximum height flow passage in an inverted U siphon drain.

3. A method of draining a hot water humidifier as claimed in claim 1 including the step of setting said exhaustion height with a lower flow portal in said tank.

4. A method of draining a hot water humidifier as claimed in claim 1 wherein the step of automatically siphoning occurs in the absence of any controlling valve action prior to or subsequent to said siphoning action.

5. A method of draining a hot water humidifier as claimed in claim 1 wherein said automatic siphoning occurs without drain valving.

6. A method of draining a hot water humidifier having a humidifier tank supplied with cooler source water comprising:

admixing said cooler source water in said tank with said hot water until the admixture reaches a predetermined siphon height and is less than a predetermined temperature; and thereafter, automatically siphoning and draining said admixture until said admixture reaches a lower siphon exhaustion height;

wherein said admixing step includes adding said cooler source water downstream of said lower siphon exhaustion height.

7. A method of draining a hot water humidifier as claimed in claim 6 including the step of setting said siphon height by a maximum height flow passage in an inverted U siphon drain.

8. A method of draining a hot water humidifier as claimed in claim 6 including the step of setting said exhaustion height with a lower flow portal in said tank.

9. A method of draining a hot water humidifier as claimed in claim 6 wherein the step of automatically siphoning occurs in the absence of any controlling valve action prior to or subsequent to said siphoning action.

10. A method of draining a hot water humidifier as claimed in claim 6 wherein said automatic siphoning occurs without drain valving.

11. A method of draining a hot water humidifier having a humidifier tank supplied with cooler source water comprising:

admixing said cooler source water in said tank with said hot water until the admixture reaches a predetermined siphon height;

automatically siphoning and draining said admixture until the admixture reaches a lower siphon exhaustion height, and adding said cooler source water downstream of said lower siphon exhaustion height.

12. A method of draining a hot water humidifier as claimed in claim 11 wherein said admixing step includes adding said cooler source water downstream of said lower siphon exhaustion height before said siphoning and draining step and said adding step.

13. A method of draining a hot water humidifier as claimed in claim 11 including the step of setting said siphon height by a maximum height flow passage in an inverted U siphon drain.

14. A method of draining a hot water humidifier as claimed in claim 11 including the step of setting said exhaustion height with a lower flow portal in said tank.

15. A method of draining a hot water humidifier as claimed in claim 11 wherein the step of automatically siphoning occurs in the absence of any controlling valve action prior to or subsequent to said siphoning action.

16. A method of draining a hot water humidifier as claimed in claim 11 including the step of monitoring the temperature of said hot water in said tank and admixing said cooler source water until said temperature is below a predetermined level.

17. A method of draining a hot water humidifier as claimed in claim 11 wherein said automatic siphoning occurs without drain valving.

18. A hot water humidifier with an automatic siphon drain fed with cooler source water and flushed via a drain comprising:

a humidifier tank supplied with said cooler source water;

an inverted substantially U-shaped siphon conduit automatically operable with respect to said humidifier tank having one end coupled to said humidifier tank and another end coupled to said drain;

a source conduit coupled to and feeding said cooler source water to said humidifier tank;

a valve controlling said cooler source water fed to said humidifier tank to maintain the temperature of an admixture of cooler source water and any preexisting tank water at or below a predetermined temperature during a flush cycle;

wherein when said tank is flushed and drained via an automatic siphon based upon a level of said admixture and said siphon; and wherein said source conduit is coupled to said humidifier tank via said siphon conduit.

19. A hot water humidifier with an automatic siphon drain as claimed in claim 18 wherein an apex of said siphon conduit is positioned at a level below a top of said humidifier tank above said end of said siphon conduit coupled to said humidifier tank.

20. A hot water humidifier with an automatic siphon drain as claimed in claim 18 wherein said source conduit is coupled to said humidifier tank in at least two locations about said tank.

21. A hot water humidifier with an automatic siphon drain as claimed in claim 18 further comprising an admixture temperature sensor disposed within said admixture and providing feedback to said valve.

22. A hot water humidifier with an automatic siphon drain as claimed in claim 18 further comprising an admixture temperature sensor disposed within said admixture and providing feedback to said valve to feed source water into said siphon conduit such that said admixture is at or below a predetermined temperature during said automatic siphon.

23. An automatic siphon drain for a hot water humidifier having a humidifier tank supplied with a valved water source and a drain located below said humidifier tank, the automatic siphon drain comprising:

an inverted substantially U-shaped siphon conduit having an apex and two substantially downwardly facing conduit legs, the first conduit leg adapted to be fluidly coupled to a lower part of said humidifier tank and the second conduit leg adapted to be fluidly coupled to said drain, said apex of said conduit positioned at a level below atop of said humidifier tank above the coupling of said first conduit leg to said lower part of said humidifier tank;

a water source intake adapted to be fluidly coupled to said valved water source;

a valve control adapted to control said valved water source, said valve control controlling the flow of water through said valved water source to maintain the temperature of an admixture of said water and any preexisting humidifier tank water at or below a predetermined temperature during a flush cycle of said tank; and wherein said first conduit leg fills with said admixture as said humidifier tank is substantially filled with said admixture during said flush cycle until said admixture reaches said apex of said conduit creating a siphon whereupon said admixture is automatically siphoned into said drain until said admixture substantially reaches the level of said fluid coupling of said first conduit leg; and wherein said coolant source intake is fluidly coupled to said first conduit leg.

24. An automatic siphon drain as claimed in claim 23 wherein said water source intake includes a one-way valve to prevent back flow.

25. An automatic siphon drain as claimed in claim 24 wherein said one-way valve is a check valve.

26. An automatic siphon drain as claimed in claim 23 wherein said coolant source intake is fluidly coupled to said humidifier tank in at least two locations about said tank.

27. An automatic siphon drain as claimed in claim 23 further comprising an admixture temperature sensor disposed within said admixture and providing feedback to said valve control.

* * * * *